United States Patent [19]

Smith

[11] 4,189,892

[45] Feb. 26, 1980

[54] ANGLE GUIDE APPARATUS

[75] Inventor: Harlan B. Smith, Canby, Oreg.

[73] Assignee: Erickson Air Crane Co., Hillsboro, Oreg.

[21] Appl. No.: 817,046

[22] Filed: Jul. 19, 1977

[51] Int. Cl.[2] ..... E04H 12/34

[52] U.S. Cl. ..... 52/749; 52/123; 52/127; 52/143; 52/637; 52/745; 29/243; 29/5; 29/281.5

[58] Field of Search ..... 52/40, 127, 143, 745, 52/749, 637, 632, 123; 61/46, 46.5; 29/243.5, 281.5, 281.6; 269/93

[56] References Cited

U.S. PATENT DOCUMENTS

| | | | |
|---|---|---|---|
| 2,974,760 | 3/1961 | Woolslayer et al. | 52/123 X |
| 3,094,847 | 6/1963 | Pogonowski | 52/637 X |
| 3,402,557 | 9/1968 | Steele | 61/46.5 |
| 3,469,299 | 9/1969 | Rogers | 29/200 |
| 3,704,503 | 12/1972 | Haywood | 29/281.6 X |

FOREIGN PATENT DOCUMENTS

| | | | |
|---|---|---|---|
| 1013856 | 8/1957 | Fed. Rep. of Germany | 52/632 |
| 1564472 | 3/1969 | France | 52/637 |

*Primary Examiner*—J. Karl Bell

*Attorney, Agent, or Firm*—Kolisch, Hartwell, Dickinson & Stuart

[57] ABSTRACT

An improved angle guide for use in directing a first structural member toward a position adjacent a section structural member. The angle guide includes a flange and set screw assembly for clamping to the second structural member. A brace extends from the angle guide for engagement with the second structural member for preventing rotation of the angle guide when it is under load.

14 Claims, 8 Drawing Figures

46
50b
50a
44
50
74a
74
76
78
76a
62
60
58
64
70
68
66
56
54
48

50
52
4
74
74a
64
66
62
58
60
56
72
4
68
70
54
3
78
48a
3
48
94
95
81a
90
92
76
81
80
90
110
110
88
90
110
106
86
82
84
95
100
92
74
76
94
80
80b
48
96
98
80a
80c
102
110
108
104

ANGLE GUIDE APPARATUS

BACKGROUND AND SUMMARY OF THE INVENTION

The present invention relates to transmission tower erection and more particularly to apparatus for use in guiding an upper section of a tower onto a lower section. The present invention is directed to a novel and improved angle guide for detachable mounting on the receiving end of a lower section's structural support legs.

Transmission towers for supporting power lines may be erected to considerable heights, i.e., upwardly of 300 feet in some cases. The transmission towers are constructed of steel and typically comprise multiple sections, such as a lower section onto which an upper section is lowered prior to interconnection of the sections.

It has been found useful to utilize helicopters in the erection of the tower sections, and various proposals have been considered to facilitate the guiding of a suspended upper section onto a lower section. For instance, it has been proposed to mount so-called angle guides on each of the support legs of the lower section adjacent a top portion of the legs. The angle guides are inclined at an angle and each extends inwardly for several feet directed to a hypothetical apex of a pyramid. The upper section is provided with a cable or steel strap extending between lower portions of its support legs for contacting the angle guides as the upper section is being lowered. Upon contact, the upper section may be appropriately rotated by helicopter yaw movement so that its support legs contact an associated angle guide and slide therealong. The upper section's support legs may thereby be properly positioned adjacent associated support legs of the lower section. The support legs are then bolted together.

However, prior art angle guides are deficient from a number of standpoints. First of all, known angle guides are mounted to support legs of the lower section by means of bolts inserted through accommodating holes in the angle guide and the legs. The availability of properly positioned holes in the support legs which will mate with holes in the angle guide is always subject to doubt. Known angle guides must be provided with an excessive number of holes in an attempt to ensure that the angle guide may be mounted.

Additionally, known angle guides are not readily interchangeable for use in constructing either butt or overlap joints between the section legs. Thus, it is necessary to have different models of angle guides on hand in order to accommodate either type of joint construction.

Another problem present in prior art angle guides resides in the fact that inordinately long periods of time are required in order to mount and detach the guides. This problem results from the fact that considerable effort must be extended in locating suitable bolt holes or drilling accommodating holes in the guide. Unfortunately, drilling of holes in the support legs is oftentimes structurally unacceptable.

Accordingly, it is a general object of the present invention to provide an improved angle guide apparatus which may be detachably mounted, irrespective of bolt hole positioning, on a support leg of a lower tower section.

Another object of the present invention is to provide an improved angle guide which may be interchangeably used in constructing either butt or overlap joints between the suupport legs of the upper and lower sections.

Still another object of the present invention is to provide an improved angle guide which may be readily mounted and detached from support legs having different thicknesses. To this end, the present invention contemplates a clamp construction which enables the angle guide to be rigidly clamped to the support legs of the lower section.

Yet another object of the present invention is to provide an improved angle guide which is constructed with a detachable supporting ledge for limiting the extent to which a support leg of a upper section may be positioned relative to a support leg of a lower section. The supportive ledge finds particular utility in the construction of an overlap joint.

These and additional objects and advantages of the present invention will be more readily apparent from a consideration of the accompanying drawings and the following detailed description.

DETAILED DESCRIPTION OF THE PREFERRED EMBODIMENT

Figure 1:
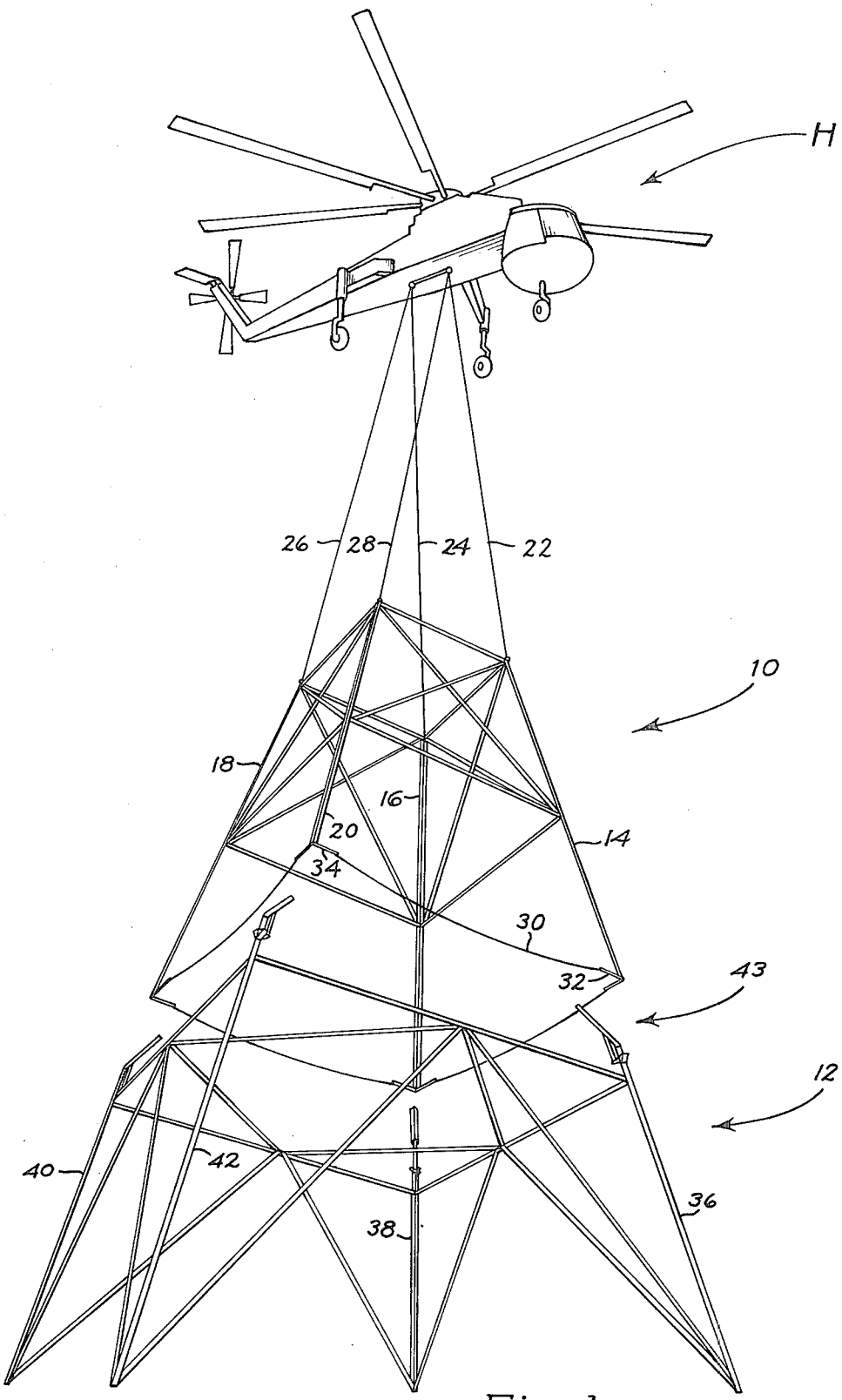
FIG. 1 is a perspective view, looking generally upwardly from the ground, showing the lowering of an upper section of a transmission tower by a helicopter onto a lower section.

Turning now to the drawings, reference is initially directed to FIG. 1. As shown, a transmission tower is being erected by a helicopter H lowering an upper section, generally designated at 10, onto a lower section, generally designated at 12. Upper section 10 is a frame assembly constructed from interconnected structural steel members and includes support legs such as angle leg members 14, 16, 18 and 20. A plurality of cables 22, 24, 26, and 28 interconnect the top of upper section 10 to the helicopter. The helicopter transports upper section 10 from a fabrication or storage site to the location of lower section 12.

Extending between the bottom of angle leg members 16, 18, 20 and 22 are cables or steel straps one of which is shown at 30. Strap 30 is joined to leg members 14, 20 by means of brackets 32, 34 which are removably mounted on the leg members.

Considering lower section 12, it can be seen that it also is constructed as a frame assembly having angle leg members 36, 38, 40 and 42. Mounted on top of each of the leg members in the lower section is a guide apparatus or angle guide, one of which is generally indicated at 43. As illustrated, each angle guide is inclined at an angle toward the interior of lower section 12 and directed upwardly toward the apex of a hypothetical pyramid. Each angle guide includes an elongate guide surface and is rigidly secured to an associated lower section leg member.

During erection of a transmission tower, upper section 10 is lowered by the helicopter until the straps interconnecting the bottom of leg members 14, 16, 18 and 20 contact an angle guide. At this point, upper section 10 is somewhat stabilized and the helicopter may be appropriately yawed until the leg members contact an associated angle guide. Upper section 10 is then lowered so that the leg members are slideably transferred along the surface of the angle guides for positioning adjacent the leg members of lower section 12. Securing bolts for interconnecting the leg members are then positioned in appropriate aligned bolt holes and upper section 10 is thereby assembled with lower section 12. The angle guides may be removed at any convenient time after holding bolts are inserted.

As mentioned previously, the present invention is directed to providing an improved angle guide which may be used interchangeably in the construction of overlap and butt joints. Accordingly, use of the improved angle guide of the present invention during the construction of overlap and butt joints will be hereinafter particularly described.

Figures 2, 3, 4:
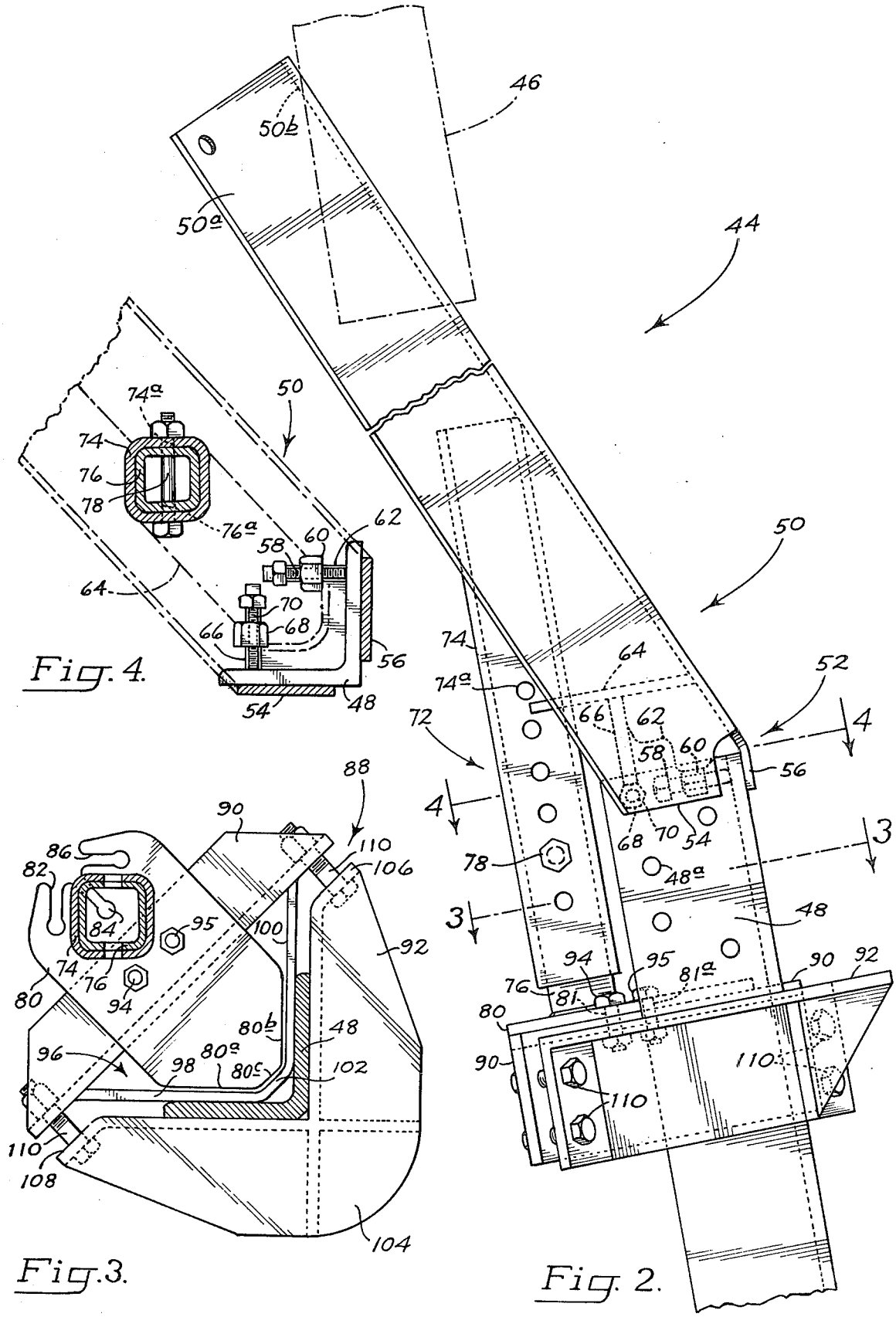
FIG. 2 is a side elevation view of an improved angle guide according to the present invention mounted on the upper portion of a support leg of a lower section for guiding an upper section support leg into position for construction of an overlap joint with a lower section support leg.
FIG. 3 is a cross-sectional view taken along lines 3—3 of FIG. 2.
FIG. 4 is a cross-sectional view taken along lines 4—4 of FIG. 2.

With reference directed to FIGS. 2–4, an angle guide according to the present invention is generally indicated at 44 and will be described with reference to the construction of an overlap joint. Angle guide 44 is illustrated in position for directing a first angle or structural member 46, shown in dot-dash, to a position overlapping a second angle or structural member 48. First angle member 46 corresponds to a leg member of an upper tower section and second angle member 48 corresponds to a leg member of a lower tower section. Angle guide 44 includes a guide means such as a length of angle iron, indicated at 50, having legs 50*a*, 50*b*. Angle iron 50 provides an outer surface over which first angle member 46 may be slideably transferred when the inner surface of the first angle member nests over the outer surface of angle iron 50.

Angle guide 44 is detachably secured to an upper end of second angle member 48 by a clamping means generally indicated at 52. Clamping means 52 includes lip members or flanges 54, 56 which extend from the bottom of legs 50*a*, 50*b* respectively. The flanges are inclined relative to angle iron 50. Mounted within the interior of angle iron 50 are adjustable means such as a pair of set screw assemblies. An adjustable set screw 58 is threadably engaged with a nut 60 which in turn is rigidly secured to a mounting plate 62. Mounting plate 62 is connected to a supporting bracket 64 which is secured to the inner surface of angle iron 50 adjacent a lower end thereof. Another mounting plate 66 extends downwardly from bracket 64 and includes a nut 68 secured thereto. An adjustable set screw 70 is threadably engaged with nut 68. Thus, it can be seen that the set screws are selectively operable for urging the flanges against second angle member 48 so that frictional clamping action results.

In order to provide additional stability, a strut or bracing means, generally indicated at 72, is mounted within angle iron 50 and extends downwardly therefrom. Bracing means 72 includes an outer or guide tube 74 secured to bracket 64 and inside portions of angle iron 50. Slideably disposed within tube 74 is an elongate member such as a second tube 76 which is selectively shiftable along its longitudinal axis. Each of tubes 74, 76 is provided with a plurality of cooperating apertures, such as shown at 74*a*, 76*a*. The apertures may be selectively aligned so that tube 76 may be maintained in a predetermined position. A bolt 78 is conveniently used to interconnect the tubes through the aligned apertures.

As can be best seen from a consideration of FIG. 3, a foot member 80 is secured to a bottom of tube 76 and extends generally at right angles thereto. Foot member 80 is formed from a plate member and includes a front end having tapered edges 80*a*, 80*b* which, if extended, would meet generally at a right angle. A beveled portion 80*c* intersects edges 80*a*, 80*b*. At the other end of foot member 80 there are provided multiple elongate slots 82, 84 and 86. Additionally, foot member 80 is provided with spaced-apart apertures 81, 81*a* each of which may accommodate an inserted bolt (see FIG. 2).

A second clamping means for frictionally engaging second angle member 48 is indicated generally at 88. Clamping means 88 includes a first bracket member 90 detachably mounted on foot member 80 and a second bracket member 92. The bracket members are detachably secured to each other. As illustrated, bracket member 90 is an angle member and is connected to foot member 80 by means of bolts 94, 95. In addition, bracket member 90 includes a pressure plate, generally indicated at 96, having plate portions 98, 100 which are positioned at right angles relative to each other. Pressure plate 96 is contoured to engage inner wall portions of second angle member 48. An intermediate portion 102 is formed during forming of pressure plate 96.

Considering details of bracket member 92, it can be seen that it is formed from a pair of joined angles having a common upper surface 104. Surface 104 serves as a support means or supporting ledge for first angle member 46 after it has been guided over angle iron 50 to its overlapped position adjacent second angle member 48. As can be seen, bracket member 92 is contoured to engage outer wall portions of second angle member 48. In addition, bracket member 92 is provided with flange portions 106, 108 which include apertures for alignment with corresponding apertures in bracket member 90. As shown in FIGS. 2 and 3, detachable means such as bolts 110 are adjustable for selectively positioning the bracket members and clamping second angle member 48 between pressure plate 96 and bracket member 92.

In the erection of tower sections requiring an overlap joint, angle guide 44 may be used in the following manner. Bracket member 92 is loosely connected to bracket member 90 so that adequate space exists between pressure plate 96 and the inner faces of bracket member 92. Clamping means 88 is then slid downwardly over second angle member 48 until the top of the second angle member contacts the point of intersection between the legs of angle iron 50 and their respective flanges 54, 56. Set screws 58, 70 are then tightened to clamp angle guide 44 securely to second angle member 48.

Tube 76 is then slideably shifted within guide tube 74 to a position so that supporting ledge 92 will be spaced from the top of second angle member 48 a distance corresponding to the desired length of overlap. Tube 76 is then secured to tube 74 by means of bolt 78. Bolts 110 are then tightened in order to provide adequate clamping. First angle member 46 may then be slideably transferred over the outer surface of angle iron 50 until a bottom edge thereof contacts supporting ledge 92. It is to be noted that considerable jarring can be applied to angle iron 50 during lowering of an upper section. Bracing means 72 provides adequate structural support for preventing undesired twisting or rotation of angle guide 44 relative to second angle member 48.

Securing bolts are then inserted through aligned apertures or bolt holes (such as shown at 48*a*) in angle members 46, 48 for securing the angle members together. Before the bolts are completely tightened, it is necessary to remove bolts 94, 95 as well as set screws 58, 70 so that angle guide 44 may be pivoted out of position and removed. Sufficient flexibility is present in first angle member 46 to permit the withdrawal of flanges 54, 56 from between first and second angle members 46, 48. The angle members are then fully tightened together while being supported on bracket member 92. Bracket members 90, 92 are disconnected by removing bolts 110.

From the above, it can be seen that angle guide 44 provides several important advantages. First of all, angle guide 44 may be readily mounted on a second angle member or lower section leg member independently of bolt hole provision in the lower section's leg members. This is accomplished by the fact that angle guide 44 is provided with a flange and set screw construction for gripping upper edges of the second angle member. In addition, it is to be noted that bracing means 72 is rigidly positioned by virtue of detachably mounted clamping means 88. A desired amount of gripping action may be provided by clamping means 88 and the entire angle guide is rigidly mounted on second angle member 48.

Figure 6:
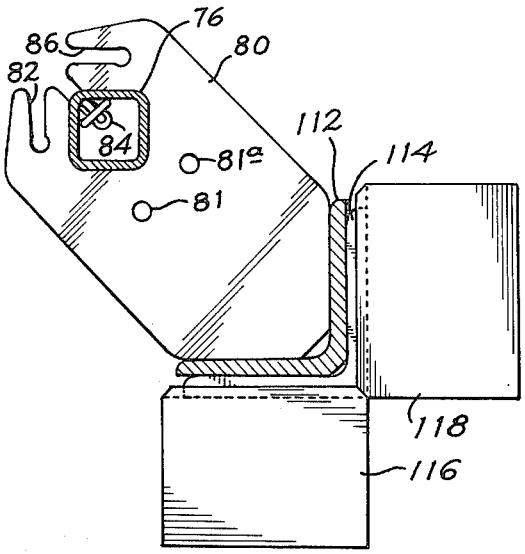
FIG. 6 is a cross-sectional view taken along lines 6—6 of FIG. 5.
Figure 8:
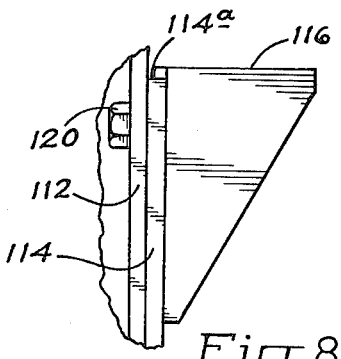
FIG. 8 is a view taken along lines 8—8 of FIG. 5.
Figure 5:
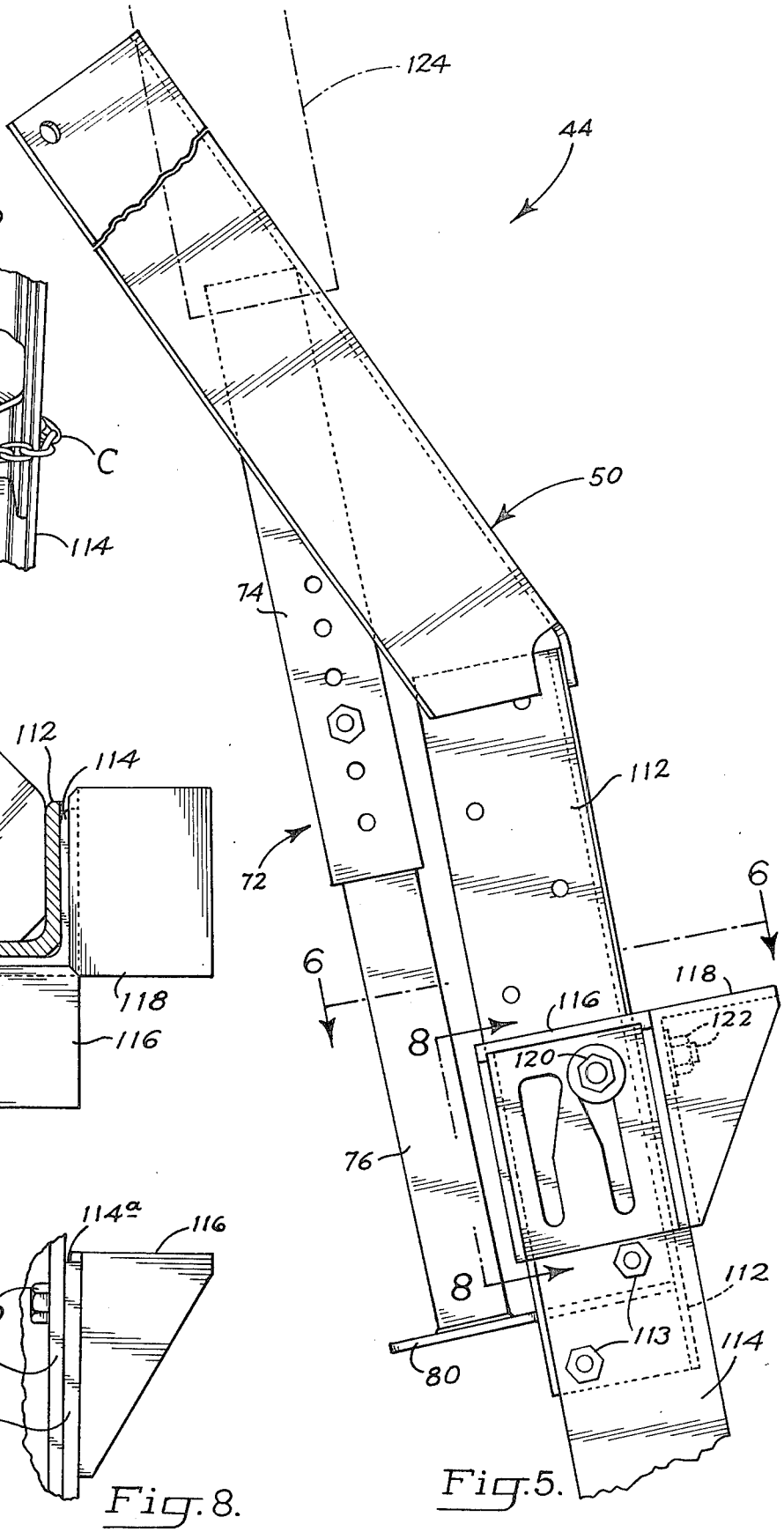
FIG. 5 is a side elevation view of the angle guide mounted adjacent a support leg of a lower section prior to formation of a butt joint.

Additional advantages of the present invention reside in the fact that angle guide 44 may be readily used in the construction of a butt joint. For instance, as shown in FIGS. 5 and 6, an interior splice angle 112 is suitably secured by bolts 113 to extend within a lower section's leg member 114. Splice angle 112 extends upwardly from a top edge 114*a* of leg member 114 (see FIG. 8). Clamping means 88 is removed from angle guide 44 and the angle guide is positioned on top of splice angle 112. A pair of blocks or support ledges 116, 118 are mounted to leg member 114 by suitable bolts 120, 122 respectively. The tops of support ledges 116, 118 are positioned approximately 3/16ths to ½ inch above top edge 114*a* of leg member 114. Tube 76 is then shifted within guide tube 74 until foot member 80 is positioned somewhat beneath the lower edges of support ledges 116, 118 and the set screws are tightened for clamping action.

Figure 7:
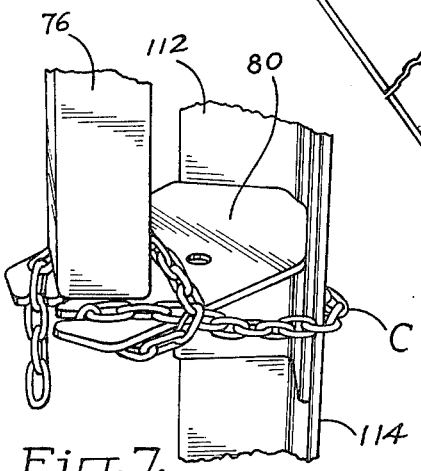
FIG. 7 is a perspective view, partially cut away, illustrating the use of a chain to secure the angle guide in position.

Depending upon the designed length of splice angle 112, foot member 80 may be positioned for contacting either the inside surface of the splice angle or the inside surface of leg member 114. As shown in FIGS. 5–7, foot member 80 is positioned against splice angle 112. A chain C is inserted through slot 84 with one of its links positioned crosswise as shown in FIG. 6. Chain C is then wrapped around leg member 114 and inserted through slot 82. The chain is then wrapped behind adjustable tube 76 and finally inserted in slot 86. Thus, it can be seen that chain C holds foot member 80 against splice angle 112 and together with bracing means 72 adequately prevents rotation of angle guide 44 from splice angle 112 when the angle guide is under load.

Angle guide 44 is then in position for guiding an upper section leg member 124, shown in dot-dash, over its surface until the bottom edge of the leg is seated upon support ledges, 116, 118. Securing bolts are then inserted through aligned holes in leg member 124 and the splice angle. Chain C is unlocked, the set screws released and angle guide 44 is removed. The securing bolts are then tightened while leg member 114 is supported on support ledges 116, 118. Support ledges 116, 118 are then removed and outer splice plates are positioned across the butt joint and secured with appropriate bolts.

In the description of the construction of the butt joint, leg member 124 corresponds to a first angle member and splice plate 112 corresponds to a second angle member.

From the above, it can be seen that angle guide 44 of the present invention can be interchangeably used in the erection of either overlap or butt joints wholly independently of bolt hole placement in either upper or lower section leg members. Additionally, it is to be noted that angle guide 44 may be readily clamped to interior splice or lower section leg members having varying thicknesses. This is a result of the set screw and flange construction which will accommodate any foreseeable size of angle thickness.

Another advantage of the present invention resides in the fact that bracing means is provided having an adjustable tube which may be shifted within a guide tube. Angle guide 44 may thereby be effectively used in situations requiring long angle splices in the formation of a butt joint or relatively short overlap joints. The flexibility of angle guide 44 for various joint conditions and designs should be readily apparent.

The angle guide of the present invention may be used in applications involving cranes rather than helicopters. Furthermore, various types of structural members could be used instead of the described angle members. For instance, tubular or channel members are often used in tower assemblies, and the angle guide of the present invention may be readily used in such situations.

While the invention has been particularly shown and described with reference to the foregoing preferred embodiment, it will be understood by those skilled in the art that other changes in form and detail may be made therein without departing from the spirit and scope of the invention as defined in the apendant claims.

It is claimed and desired to secure by Letters Patent:

1. Apparatus for use in directing a first angle member toward a second angle member comprising:
   - guide means for providing a surface over which the first angle member may be slideably transferred;
   - clamping means provided on said guide means for detachably securing said guide means to the second angle member; and
   - bracing means extending from said guide means for preventing rotation of said guide means relative to the second angle member.

2. The apparatus of claim 1 wherein said clamping means includes a flange adapted to fit over an outer surface portion of the second angle member and adjustable means opposed to said flange selectively operable for urging said flange against the second angle member.

3. The apparatus of claim 2 wherein said flange is inclined relative to said guide means.

4. The apparatus of claim 1 wherein said bracing means includes a foot member projecting therefrom for engaging the second angle member.

5. The apparatus of claim 4 wherein said foot member includes support means detachably connected thereto for providing a supporting ledge for the first angle member after it has been transferred over said guide means to a predetermined position relative to the second angle member.

6. The apparatus of claim 5 wherein said support means includes first and second bracket members contoured to engage inner and outer wall portions, respectively, of the second angle member, said bracket members being detachably secured together and selectively positionable relative to each other for clamping the second angle member therebetween.

7. The apparatus of claim 6 wherein said second bracket member includes an upper surface defining said supporting ledge, said surface extending on both sides of said outer wall portions.

8. The apparatus of claim 4 wherein said bracing means includes an elongate member selectively shiftable along its longitudinal axis for positioning said foot member.

9. Apparatus for use in directing a first structural member toward a second structural member comprising:

guide means for providing a surface over which the first structural member may be slidably transferred; and clamping means provided on said guide means for detachably securing one end of said guide means to an end portion of the second structural member, said clamping means including adjustable means selectively operable for urging said guide means against the second structural member to produce frictional engagement therebetween, said one end being formed as a flange opposed to said adjustable means.

10. The apparatus of claim 9 including bracing means connected to said guide means for engaging the second structural member and preventing rotation of said guide means relative thereto.

11. The apparatus of claim 10 including support means detachably connected to said bracing means for providing a supporting ledge for the first structural member after it has been directed over said guide means to a predetermined position relative to the second structural member.

12. The apparatus of claim 11 wherein said support means includes first and second bracket members contoured to engage inner and outer wall portions, respectively, of the second structural member, said bracket members being detachably secured together and selectively positionable relative to each other for clamping the second structural member therebetween.

13. The apparatus of claim 12 wherein said second bracket member includes an upper surface defining said supporting ledge, said surface extending on both sides of said outer wall portions.

14. The apparatus of claim 10 wherein said bracing means includes an elongate member selectively shiftable along its longitudinal axis for positioning said foot member.

* * * * *